US006424697B1

(12) United States Patent
Zastrow et al.

(10) Patent No.: US 6,424,697 B1
(45) Date of Patent: Jul. 23, 2002

(54) DIRECTED ENERGY BEAM WELDED CT DETECTOR COLLIMATORS

(75) Inventors: Dale S. Zastrow, Waukesha; Jimmie A. Beacham, Jr., West Allis, both of WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 18 days.

(21) Appl. No.: 09/751,547

(22) Filed: Dec. 29, 2000

(51) Int. Cl.[7] ..... G21K 1/02

(52) U.S. Cl. ..... 378/148; 378/149; 378/154; 219/121.14; 219/121.64

(58) Field of Search ..... 378/145, 147, 378/148, 149, 154; 228/262.7, 262.5; 219/121.12, 121.13, 121.14, 121.6, 121.63, 78.01, 61.1, 61.13, 61.3, 121.64

(56) References Cited

U.S. PATENT DOCUMENTS 4,203,021 A * 5/1980 Andel et al. ..... 219/121.12
4,679,221 A * 7/1987 O'Brien et al. ..... 378/148
4,920,552 A * 4/1990 Hermens ..... 378/153
5,231,654 A 7/1993 Kwasnick et al. ..... 378/147
5,231,655 A 7/1993 Wei et al. ..... 378/147
5,293,417 A 3/1994 Wei et al. ..... 378/147
5,303,282 A 4/1994 Kwasnick et al. ..... 378/147
5,524,041 A 6/1996 Grenier ..... 378/147
5,644,615 A 7/1997 Van Der Borst et al. ... 378/147
6,175,615 B1 1/2001 Guru et al. ..... 378/149

* cited by examiner

*Primary Examiner*—David P. Porta
*Assistant Examiner*—Therese Barber
(74) *Attorney, Agent, or Firm*—Carl B. Horton, Esq.; Armstrong Teasdale LLP

(57) ABSTRACT

One embodiment of the present invention is a method for constructing a post-patient collimator for a computed tomographic (CT) imaging system, the method including steps of: edge welding collimator plates to a top rail using at least one directed energy beam welder; and edge welding the collimator plates to a bottom rail, using the at least one directed energy beam welder.

The above described embodiment provides an efficient and less expensive method for manufacturing a post-patient collimator for a CT imaging system than embodiments requiring use of precision combs for accurately positioning the plates.

32 Claims, 7 Drawing Sheets

DIRECTED ENERGY BEAM WELDED CT DETECTOR COLLIMATORS

BACKGROUND OF THE INVENTION

This invention relates generally to computed tomography imaging systems, and more particularly to post-patient collimators used in such systems and methods for making such collimators.

In at least one known computed tomography (CT) imaging system configuration, an x-ray source projects a fan-shaped beam which is collimated to lie within an X-Y plane of a Cartesian coordinate system and generally referred to as the "imaging plane". The x-ray beam passes through the object being imaged, such as a patient. The beam, after being attenuated by the object, impinges upon an array of radiation detectors. The intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile.

In known third generation CT systems, the x-ray source and the detector array are rotated with a gantry within the imaging plane and around the object to be imaged so that the angle at which the x-ray beam intersects the object constantly changes. A group of x-ray attenuation measurements, i.e., projection data, from the detector array at one gantry angle is referred to as a "view". A "scan" of the object comprises a set of views made at different gantry angles, or view angles, during one revolution of the x-ray source and detector. In an axial scan, the projection data is processed to construct an image that corresponds to a two dimensional slice taken through the object. One method for reconstructing an image from a set of projection data is referred to in the art as the filtered back projection technique. This process converts the attenuation measurements from a scan into integers called "CT numbers" or "Hounsfield units", which are used to control the brightness of a corresponding pixel on a cathode ray tube display.

In a multislice imaging system, the detector comprises a plurality of parallel detector rows, wherein each row comprises a plurality of individual detector elements. A multislice detector is capable of providing a plurality of images representative of a volume of an object. Each image of the plurality of images corresponds to a separate "slice" of the volume. The thickness or aperture of the slice is dependent upon the thickness of the detector rows. It is also known to selectively combine data from a plurality of adjacent detector rows (i.e., a "macro row") to obtain images representative of slices of different selected thicknesses.

It is known to provide multislice CT detectors with a post-patient collimator. These collimators include many precisely aligned plates and wires to collimate x-rays impinging on and to attenuate x-rays impinging between individual scintillating detector elements. In one known system, alignment of the collimator plates and attachment of the wires is accomplished with slots and notches in various components for alignment, and adhesives for bonding. The manufacturing steps presently required for precision alignment of the collimator plates and wires add considerably to manufacturing costs. For example, to manufacture one known collimator, upper and lower combs with precision slots, slot spacings, and slot alignments are required for insertion of collimator plates. Welding has not been practical in known post-patient collimators because of induced distortions in collimator plates resulting from the welding process itself.

It would therefore be desirable to provide precision-aligned post-patient collimators for CT imaging systems and methods for manufacturing them that are more efficient and less expensive than those that require precision combs.

BRIEF SUMMARY OF THE INVENTION

There is thus provided, in one embodiment of the present invention, a method for constructing a post-patient collimator for a computed tomographic (CT) imaging system, the method including steps of: edge welding collimator plates to a top rail using at least one directed energy beam welder; and edge welding the collimator plates to a bottom rail, using the at least one directed energy beam welder.

The above described embodiment provides an efficient and less expensive method for manufacturing a post-patient collimator for a CT imaging system than embodiments requiring use of precision combs for accurately positioning the plates.

DETAILED DESCRIPTION OF THE INVENTION

Figure 1:
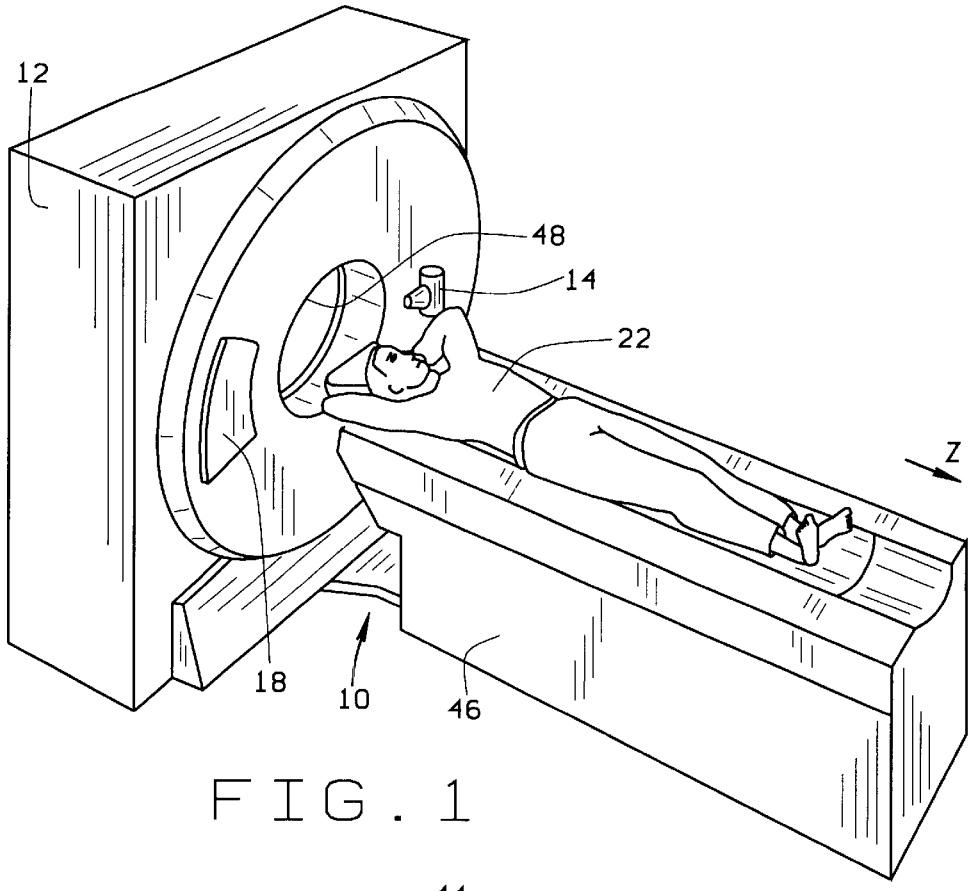
FIG. 1 is a pictorial view of a CT imaging system.
Figure 2:
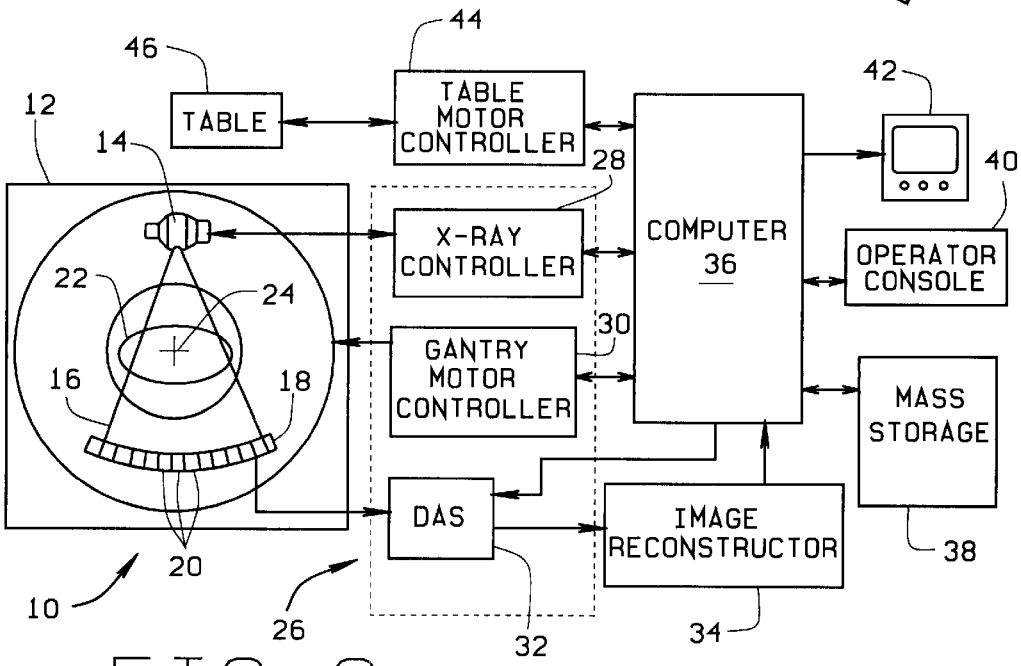
FIG. 2 is a block schematic diagram of the system illustrated in FIG. 1.

Referring to FIGS. 1 and 2, a computed tomograph (CT) imaging system 10 is shown as including a gantry 12 representative of a "third generation" CT scanner. Gantry 12 has an x-ray source 14 that projects a beam of x-rays 16 toward a detector array 18 on the opposite side of gantry 12. Detector array 18 is formed by detector elements 20 which together sense the projected x-rays that pass through an object 22, for example a medical patient. Each detector element 20 produces an electrical signal that represents the intensity of an impinging x-ray beam and hence the attenuation of the beam as it passes through patient 22. During a scan to acquire x-ray projection data, gantry 12 and the components mounted thereon rotate about a center of rotation 24. Detector array 18 may be fabricated in a single slice or multi-slice configuration. In a multi-slice configuration, detector array 18 has a plurality of rows of detector elements 20, only one of which is shown in FIG. 2.

Rotation of gantry 12 and the operation of x-ray source 14 are governed by a control mechanism 26 of CT system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector elements 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 in gantry 12. Particularly, table 46 moves portions of patient 22 through gantry opening 48.

Figure 3:
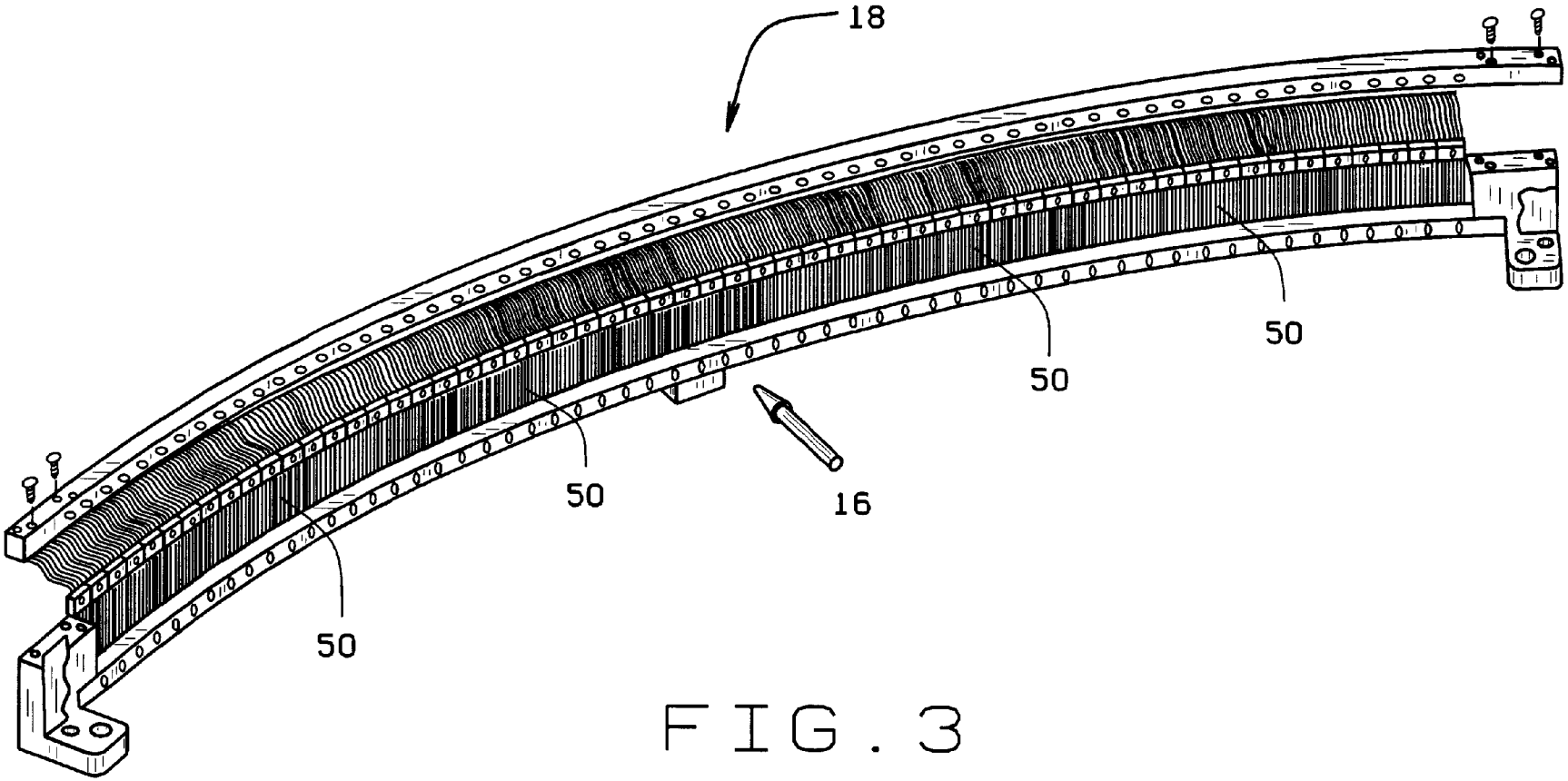
FIG. 3 is a drawing of a multislice detector array of the system illustrated in FIG. 1.
Figure 4:
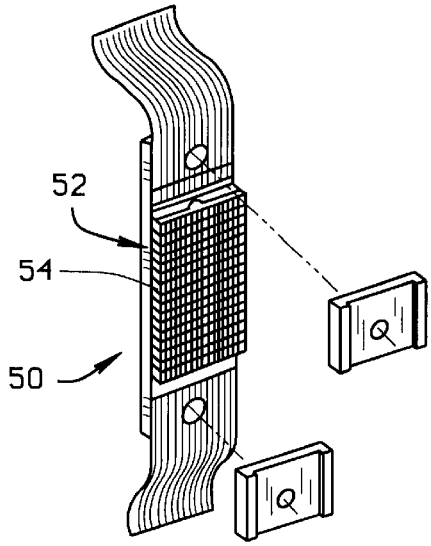
FIG. 4 is a drawing of a detector module of the detector array illustrated in FIG. 3.

In one embodiment, and referring to FIGS. 3 and 4, detector array 18 comprises a plurality of modules 50. Each module 50 includes a scintillator array 52 and a photodiode array 54. Detector elements 20 include one photodiode of photodiode array 54, and a corresponding scintillator of scintillator array. Each module 50 of detector array 18 comprises a 16×16 array of detector elements 20, and detector array 18 comprises fifty-seven such modules 50. Dectector array 18 is thus capable of acquiring projection data for up to 16 image slices simultaneously.

Figure 5:
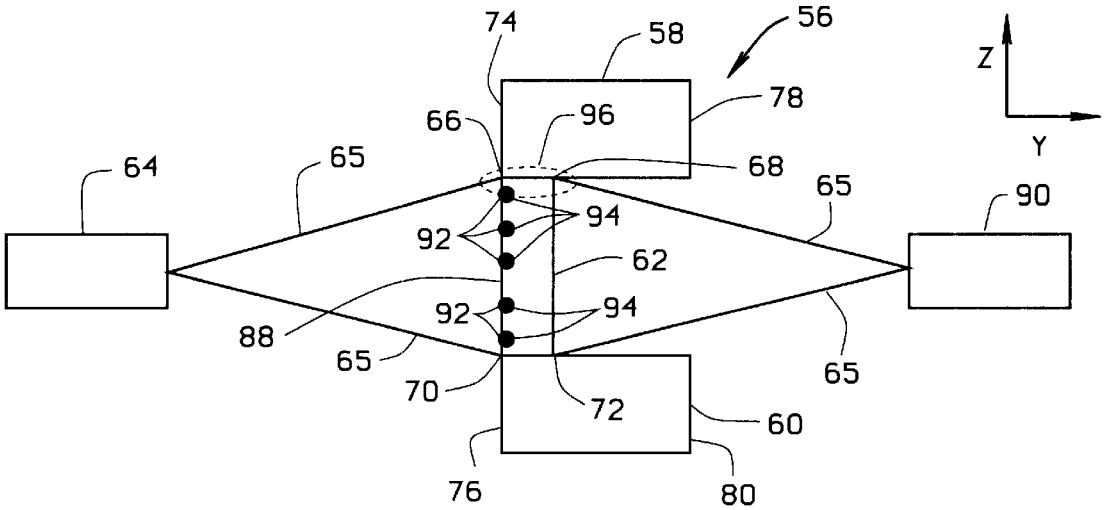
FIG. 5 is a schematic cross-sectional view of the welding of a collimator plate to rails of a collimator in one embodiment of the present invention.

In one embodiment and referring to FIG. 5, to collimate x-rays 16 after they have passed through an object or patient 22, a post-patient collimator 56 is disposed over detector array 18. Post-patient collimator 56 comprises a top rail 58 and a bottom rail 60 spaced from and parallel to top rail 58. A plurality of collimator plates 62 (e.g., tungsten plates) are arranged radially between each rail 58, 60. (FIG. 5 is a cross-sectional view of post-patient collimator 56 through one collimator plate 62.) To attach collimator plates to rails 58 and 60, collimator plates 62 are each edge-welded at opposite ends to rails 58 and 60 using at least one directed energy beam welder 64. The use of edge welding prevents warping of collimator plates out of the plane of FIG. 5. Distortion inherent in other welding methods, including laser welding not specifically directed at edges of collimator plates 62, is avoided. Suitable types of directed energy beam welders 64 include those utilizing directed energy beams 65 comprising photons (e.g., laser beam welders) and those utilizing particles (e.g., electron beam welders). Directed energy beams 65 are thin beams of energy that concentrate their energy at a single point. (FIG. 5 is intended to show narrow beams 65 directed at different locations, i.e., 66, 68, 70, and 72 rather than two fan beams of energy.)

In particular, a top rear corner 66, a top front corner 68 a bottom rear corner 70, and a bottom front corner 72 of collimator plates 62 are edge welded by directed energy beam welding in the plane of FIG. 5. Top rear corner 66 and bottom rear corner 70 are edge welded towards a rear 74 of top rail 58 and towards a rear 76 of bottom rail 60, respectively. Top front corner 68 and bottom front corner 72 are edge welded towards a front 78 of top rail 58 and towards a front 80 of bottom rail 60, respectively.

Figure 6:
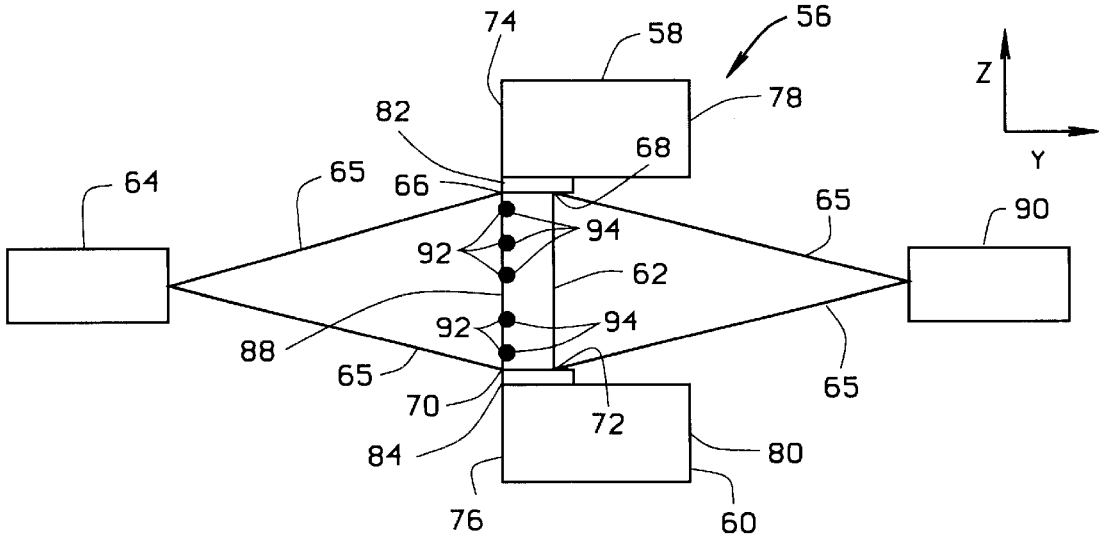
FIG. 6 is a schematic cross-sectional view of a post-patient collimator embodiment of the present invention that is constructed in sections.
Figure 7:
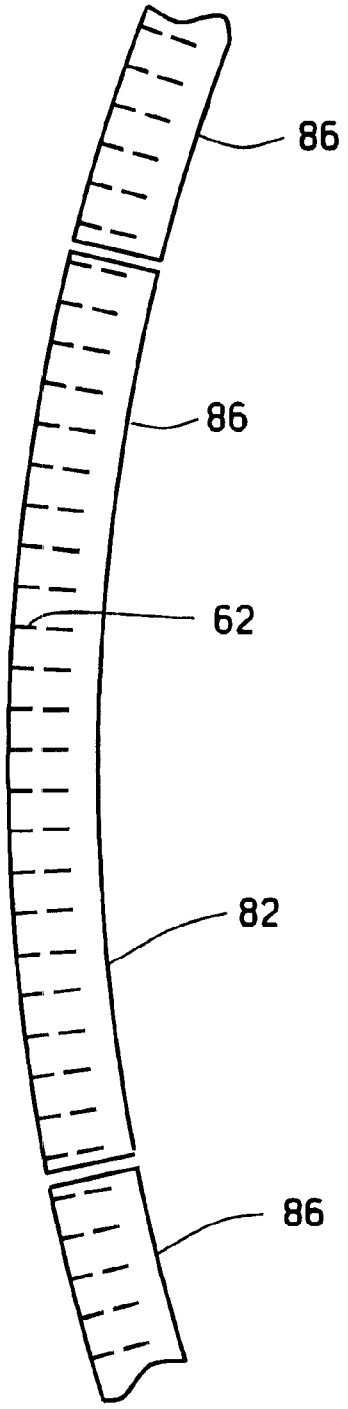
FIG. 7 is an illustration of the radial arrangement of the sections of a post-patient collimator embodiment of the present invention.

In one embodiment and referring to FIG. 6, a collimator is prepared by assembling a plurality of sections. For each collimator section, a plurality of collimator plates 62 are edge welded, using at least one directed energy beam welder, to curved metal (e.g., steel) top and bottom segments 82 and 84, respectively. Each segment 82 and 84 has a cross sectional area and length smaller than that of rails 58, 60 to form sections 86 of a collimator. Sections 86 are then radially arrayed between and fastened to top and bottom rails 58 and 60. (The radial arrangement of sections 86 is illustrated in FIG. 7, which shows collimator plates 62 that are not actually visible in a top view as hidden lines.) Top segments 82 are affixed to top or upper rail 58 and bottom segments 84 are affixed to bottom or lower rail 60. Wires 92 (such as tungsten wires) are also affixed to collimator plates 62 in a direction transverse to rear edges 88 of the collimator plates 62.

A fixture (not shown) is used to hold collimator plates 62 and rails 58, 60 (or segments 82, 84) in position relative to one another. This fixture serves essentially the same purpose as a comb in a conventional post-patient collimator. However, unlike a comb, a fixture is needed only during welding of post-patient collimator 56. The fixture is not, and does not become a part of collimator 56, and can be re-used as needed. It is not necessary to use spacers, such as the molybdenum spacers used in at least one known post-patient collimator.

In one embodiment, two directed energy beam welders 64, 90 are used to weld collimator plates 62 to rails 58 and 60. In another embodiment, two welders 64, 90 are used to weld collimator plates 62 to segments 82 and 84. One of the welders produces the rear welds, while the other produces the front welds.

For a multislice detector array 18, attenuating wires 92 (e.g., tungsten wires) are strung across collimator 56 in spaced notches 94 on rear edges 88 of collimator plates 62. Wires 92 provide x-ray attenuation between detector rows. In one embodiment of the present invention, a directed energy beam welder 64 is used to weld wires 92 onto collimator plates 62. In another embodiment, the precision of directed energy beam welders allows the use of collimator plates 62 without notches 94. Wires 92 are strung across collimator plates 62 transverse to rear edges 88 and are accurately positioned against the collimator plates, for example, by using a fixture. Wires 94 are then welded to collimator plates 62 using a directed energy beam welder 64.

In one embodiment, laser welders are used as welders 64 and 90 and their welds are accurately aimed and operated by computers (not shown) under program control.

Figure 8:
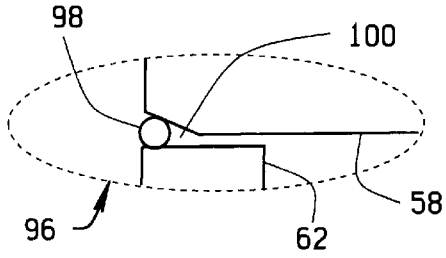
FIG. 8 is an enlargement of a region of FIG. 5, showing how steel wire is used in one embodiment to take up spacing tolerance in a z-direction.

FIG. 8 is an enlargement of region 96 of FIG. 5, showing how a wire 98 (for example, steel wire) is used in one embodiment to take up collimator plate 62 height and/or rail 58, 60 spacing tolerance in a z-direction. Wire 98 is inserted in chamfered gaps 100 between at least one of top rail 58 or bottom rail 60 and collimator plates 62. (The selection of which one or both of rails 58 and 60 is a design choice.) Wire 98 is welded on one side to the selected rail 58 (or 60) and on the other side to collimator plate 62. The welds of wire 98 to the selected rail 58 (or 60) are at least in chamfered gaps 100. In one embodiment using welded wire 98, a weld at 68 is omitted. Also in a segmented embodiment of the present invention, chamfered gaps 100 are provided between at least one segment 82 or 84 and collimator plates 62 rather than between rail 58 or 60 and plate 62. Chamfers forming chamfered gap 100 can be in either plate 62 or the opposing segment or rail, or both.

Figure 9:
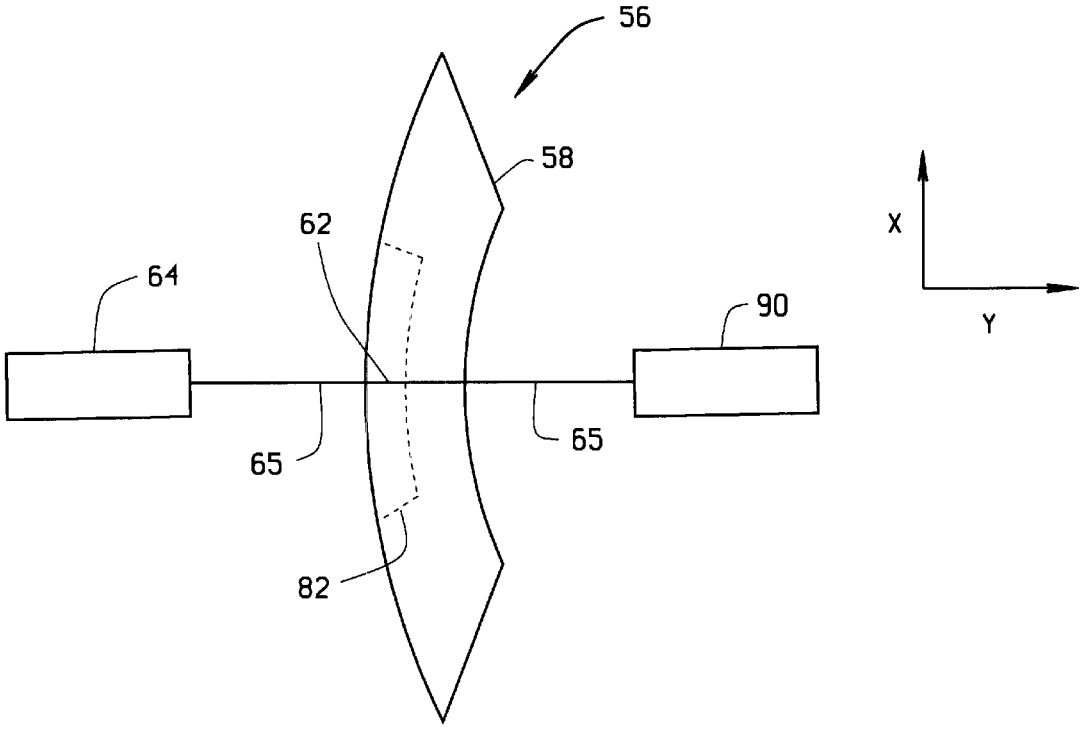
FIG. 9 is a top view of the collimator and welder configuration shown in FIG. 5.

FIG. 9 is a top view in an x-y plane of the collimator and laser welder configuration shown in FIG. 5 (or FIG. 6) showing a phantom outline of a segment 82 (if used) and the location of one collimator plate 62 welded to rail 58 (or segment 82). (Neither segment 82, if used, nor collimator plate 62 would actually be visible from the top of collimator 56.) FIG. 9 illustrates the curvature of collimator 56, which corresponds to that of detector array 18. The arrangement of collimator plates 62 in collimator 56 is such as to provide collimation between detector elements 20 that are adjacent one another in the same row or slice of detector array 18.

Figure 10:
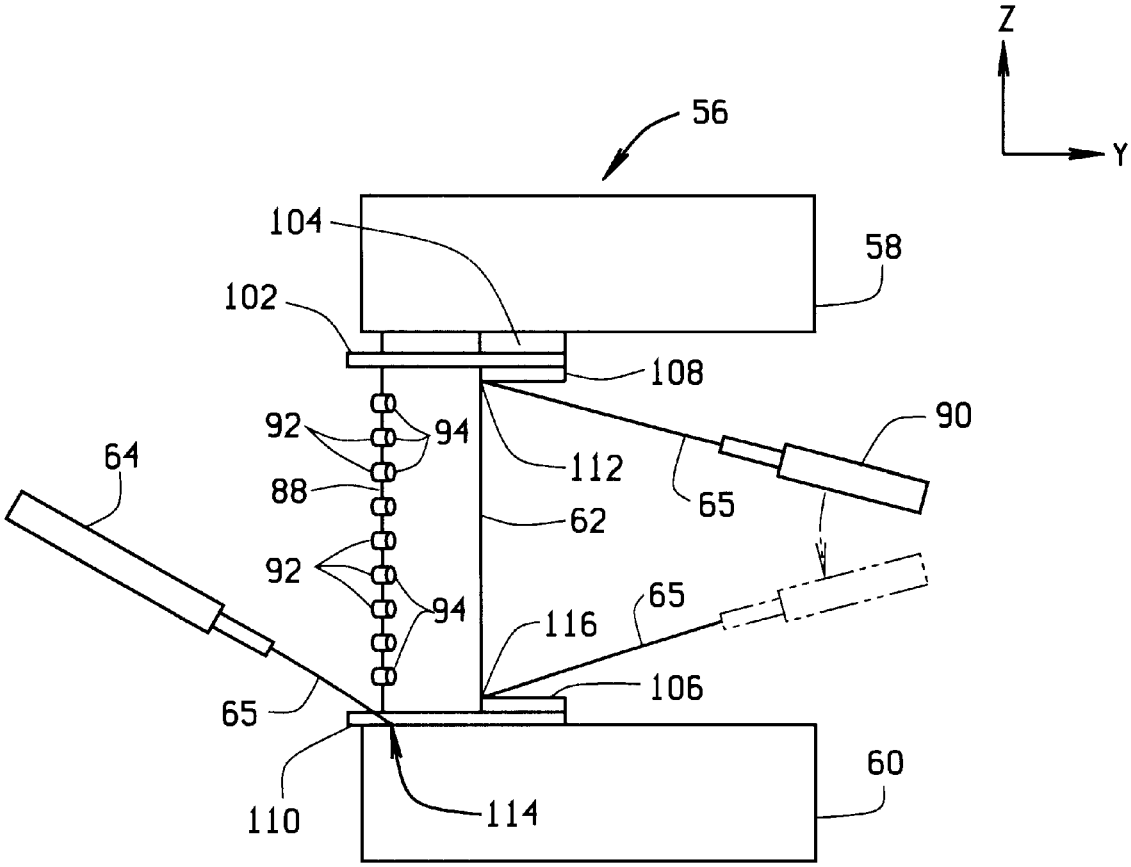
FIG. 10 is an illustration of laser welding of a collimator in one embodiment in conjunction with a comb and optional molybdenum spacers.

In another embodiment and as shown in FIG. 10, laser welding is used in conjunction with a comb 102 affixed to at least one of rail 58 or 60 and optional spacers 104, 106, 108, for example, molybdenum spacers. In the embodiment illustrated in FIG. 10, collimator plates 62 are positioned in slots of combs 102, 110 and directed energy beam welders 64, 90 weld areas 112, 114 and 116. In one embodiment, welder 64 is also used to weld wires 92 into wire notches 94.

It is clear that the various embodiments of the invention provide more efficient and less expensive manufacturing methods for producing post-patient collimators. The welded collimators themselves are less expensive and potentially more durable than collimators having adhesive bonds, whether or not a comb is part of the collimator. While the invention has been described in terms of various specific embodiments, those skilled in the art will recognize that the invention can be practiced with modification within the spirit and scope of the claims.

What is claimed is:

1. A method for constructing a post-patient collimator for a computed tomographic (CT) imaging system, said method comprising the steps of:

edge welding collimator plates to a top rail using at least one directed energy beam welder; and edge welding the collimator plates to a bottom rail, using the at least one directed energy beam welder.

2. A method in accordance with claim 1 further comprising the step of positioning the collimator plates and the top rail and bottom rail in a fixture to hold the collimator plates and the top and bottom rails in position relative to one another during welding.

3. A method in accordance with claim 1 wherein the top rail and the bottom rail each have a front and a rear, the collimator plates each have a top front corner, a top rear corner, a bottom front corner, and a bottom rear corner, and wherein each edge welding step comprises edge welding the top front corner and the bottom front corner of a collimator plate towards the front of the top rail and towards the front of the bottom rail, respectively, and the top rear corner and the bottom rear corner of the collimator plate towards the rear of the top rail and towards the rear of the bottom rail, respectively, using a pair of directed energy beam welders.

4. A method in accordance with claim 1 wherein the welded collimator plates are tungsten plates.

5. A method in accordance with claim 1 wherein further comprising the step of stringing attenuating wires through notches in the collimator plates.

6. A method in accordance with claim 5 further comprising the step of welding the attenuating wires to the collimator plates using a directed energy beam welder.

7. A method in accordance with claim 6 wherein the attenuating wires are tungsten wires.

8. A method in accordance with claim 1 wherein the collimator plates are unnotched, and further comprising the steps of stringing attenuating wires across the collimator plates, positioning the wires against the collimator plates using a fixture, and welding the attenuating wires to the collimator plates using a directed energy beam welder.

9. A method in accordance with claim 1 wherein at least one of the edge welding steps comprises the steps of inserting a wire into chamfered gaps between the collimator plates and at least one rail selected from the top rail and the bottom rail, welding the wire to the at least one selected rail at least in the chamfered gaps, and welding the wire to the collimator plates.

10. A method in accordance with claim 9 wherein the wire is a steel wire.

11. A method in accordance with claim 1 further comprising the step of inserting the collimator plates into a comb affixed to at least one of the rails.

12. A method in accordance with claim 1 wherein the at least one directed energy beam welder comprises a laser welder.

13. A method in accordance with claim 1 wherein the at least one directed energy beam welder comprises an electron beam welder.

14. A method for constructing a post-patient collimator for a computed tomographic (CT) imaging system, said method comprising the steps of:

preparing a plurality of sections of the post-patient collimator, each section being prepared by steps of edge welding each of a plurality of collimator plates to a first curved metal segment using at least one directed energy beam welder and by edge welding each of the plurality of collimator plates to a second curved metal segment using at least one directed energy beam welder, the first curved metal segment thereby becoming a top of the prepared segment and the second curved metal segment thereby becoming a bottom of the prepared segment;

radially arraying the plurality of prepared sections between a top rail and a bottom rail; and affixing the top of each of the plurality of prepared sections to the top rail and the bottom of each of the plurality of prepared segments to the bottom rail.

15. A method in accordance with claim 14 further comprising the step of stringing attenuating wires through notches in the collimator plates.

16. A method in accordance with claim 15 further comprising the step of welding the attenuating wires to the collimator plates using a directed energy beam welder.

17. A method in accordance with claim 15 wherein the attenuating wires are tungsten wires.

18. A method in accordance with claim 14 wherein the collimator plates are unnotched, and further comprising the steps of stringing attenuating wires across the collimator plates, positioning the wires against the collimator plates using a fixture, and welding the attenuating wires to the collimator plates using a directed energy beam welder.

19. A method in accordance with claim 14 wherein at least one of the edge welding steps comprises the steps of inserting a wire into chamfered gaps between the collimator plates and at least one curved metal segment selected from the first curved metal segment and the second curved metal segment, welding the wire to the at least one selected curved metal segment in the charnfered gaps, and welding the wire to the collimator plates.

20. A post-patient collimator for a radiation detector of a computed tomographic (CT) imaging system, said collimator comprising a top rail, a bottom rail, and a set of collimator plates, each said collimator plate edge welded at one end to said top rail and at an opposite end to said bottom rail.

21. A post-patient collimator in accordance with claim 20 wherein said top rail and said bottom rail each have a front and a rear, and each said collimator plate has a top front corner, a top rear corner, a bottom front corner, and a bottom rear corner, each said top front corner and said bottom front corner edge welded towards said front of said top rail and said front of said bottom rail, respectively, and each said top rear corner and said bottom rear corner edge welded towards said rear of said top rail and said rear of said bottom rail, respectively.

22. A post-patient collimator in accordance with claim 20 wherein said edge welded collimator plates are tungsten plates.

23. A post-patient collimator in accordance with claim 20 wherein said collimator plates are notched, and further comprising attenuating wires strung through said notches in said collimator plates.

24. A post-patient collimator in accordance with claim 23 wherein said attenuating wires are welded to said collimator plates.

25. A post-patient collimator in accordance with claim 24 wherein said attenuating wires are tungsten wires.

26. A post-patient collimator in accordance with claim 20 wherein said collimator plates are unnotched, and said post-patient collimator further comprises attenuating wires strung across and welded to said collimator plates.

27. A post-patient collimator in accordance with claim 20 having chamfered gaps between said collimator plates and at least one of said top rail and said bottom rail, and further comprising a wire within said chamfered gap and welded to said at least one rail and each of said collimator plates.

28. A post-patient collimator for a computed tomographic (CT) imaging system, said collimator comprising:

a plurality of sections of the post-patient collimator, each said section comprising a top metal segment, a bottom metal segment, and a plurality of collimator plates, each said collimator plate edge welded to said top metal segment and to said bottom metal segment, a top rail and a bottom rail, said plurality of sections radially arrayed between said top rail and said lower rail, and each said section affixed to both said top rail and to said bottom rail.

29. A post-patient collimator in accordance with claim 28 wherein said collimator plates are notched, and further comprising attenuating wires strung through said notches.

30. A post-patient collimator in accordance with claim 29 wherein said attenuating wires are welded to said collimator plates.

31. A post-patient collimator in accordance with claim 30 wherein said attenuating wires are tungsten wires.

32. A post-patient collimator in accordance with claim 28 wherein said collimator plates are unnotched, and further comprising attenuating wires strung across and welded to said collimator plates.

* * * * *

UNITED STATES PATENT AND TRADEMARK OFFICE

CERTIFICATE OF CORRECTION

PATENT NO. : 6,424,697 B1
DATED : July 23, 2002
INVENTOR(S) : Dale S. Zastrow et al.

It is certified that error appears in the above-identified patent and that said Letters Patent is hereby corrected as shown below:

Column 8,
Line 27, add Claim 33 to read as follows:
33. A post-patient collimator in accordance with Claim 28 and further comprising a wire inserted into chamfered gaps between said collimator plates and at least one metal segment selected from said top metal segment and said bottom metal segment, said wire welded to the at least one selected metal segment in the chamfered gaps and to the collimator plates.

Signed and Sealed this

Sixth Day of January, 2004

JAMES E. ROGAN
*Director of the United States Patent and Trademark Office*